US010428675B2

(12) United States Patent
Szarvasy

(10) Patent No.: US 10,428,675 B2
(45) Date of Patent: Oct. 1, 2019

(54) SYSTEM FOR THE ACTIVE SETTING OF A RADIAL CLEARANCE SIZE AND AIRCRAFT ENGINE WITH A SYSTEM FOR THE ACTIVE SETTING OF A RADIAL CLEARANCE SIZE

(71) Applicant: Rolls-Royce Deutschland Ltd & Co KG, Blankenfelde-Mahlow (DE)

(72) Inventor: Ivo Szarvasy, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 557 days.

(21) Appl. No.: 15/234,760

(22) Filed: Aug. 11, 2016

(65) Prior Publication Data

US 2017/0044924 A1 Feb. 16, 2017

(30) Foreign Application Priority Data

Aug. 13, 2015 (DE) ..... 10 2015 215 479

(51) Int. Cl.
*F01D 11/24* (2006.01)
*F04D 29/58* (2006.01)
*F04D 29/64* (2006.01)

(52) U.S. Cl.
CPC ..... *F01D 11/24* (2013.01); *F04D 29/582* (2013.01); *F04D 29/642* (2013.01); (Continued)

(58) Field of Classification Search
CPC ..... F01D 11/14; F01D 11/20; F01D 11/24; F01D 5/12; F04D 29/644; F04D 29/642; (Continued)

(56) References Cited

U.S. PATENT DOCUMENTS 7,819,623 B2 * 10/2010 Sutherland ..... F01D 11/24 415/116

FOREIGN PATENT DOCUMENTS

EP 2604806 A2 6/2013
EP 2824283 A2 1/2015
(Continued)

OTHER PUBLICATIONS

Mueller, Reinhard, Luftstrahtriebwerke: Grundlagen, Charakteristiken, Arbeitsverhalten. Vieweg+Teubner Verlag, 1997, p. 291-293. English Abstract.

(Continued)

*Primary Examiner* — Richard A Edgar
(74) *Attorney, Agent, or Firm* — Shuttleworth & Ingersoll, PLC; Timothy J. Klima

(57) ABSTRACT

A system for the active setting of a radial clearance size between a blade tip of at least one compressor stage and/or at least one turbine stage of an aircraft engine and a housing that surrounds the at least one compressor stage and/or the at least one turbine stage is provided. The system comprises a model-based setting device, wherein the time-dependent clearance size can be approximated by the model-based setting device, with only those influencing variables being taken into account that have a time-dependent deformation behavior which is equal to or slower than the time-dependent deformation behavior of the housing. The clearance size in the cold state serves as the set point, with the clearance size being reduced by at least one previously saved value of a clearance proportion, which is determined at maximal thrust of the aircraft engine.

12 Claims, 5 Drawing Sheets

(52) U.S. Cl.
CPC .... *F05D 2220/323* (2013.01); *F05D 2260/30* (2013.01); *F05D 2260/81* (2013.01); *F05D 2270/303* (2013.01)

(58) Field of Classification Search
CPC .... F04D 29/324; F04D 29/526; F04D 29/582; F05D 2260/81; F05D 2220/323; F05D 2260/30; F05D 2270/303
See application file for complete search history.

(56) References Cited

FOREIGN PATENT DOCUMENTS

| | | |
|---|---|---|
| GB | 2417762 A | 3/2006 |
| GB | 2516048 A | 1/2015 |

OTHER PUBLICATIONS

European Search Report dated Dec. 22, 2016 from counterpart European App 16183854.5.
German Search Report dated Jun. 16, 2016 from counterpart German App No. 10 2015 215 479.3.

* cited by examiner

SYSTEM FOR THE ACTIVE SETTING OF A RADIAL CLEARANCE SIZE AND AIRCRAFT ENGINE WITH A SYSTEM FOR THE ACTIVE SETTING OF A RADIAL CLEARANCE SIZE

REFERENCE TO RELATED APPLICATION

This application claims priority to German Patent Application No. 10 2015 215 479.3 filed on Aug. 13, 2015, the entirety of which is incorporated by reference herein.

BACKGROUND

The invention relates to a system for the active setting of a radial clearance size as well as to an aircraft engine.

In order to ensure efficient operation of an aircraft engine, it is expedient to keep the clearance between the tips of the rotating turbine blades or compressor blades and the surrounding housing as small as possible. Thus, what is known from GB 2417762, for example, is a method for active clearance control (tip clearance control, TCC). Here, the housing is cooled in a settable manner by means of cooling air, namely in such a way that a defined clearance appears between the rotating rotor blade tips and the housing (or the cover bands or liners which are arranged thereat).

At that, the setting, i.e. the regulation or control of the cooling, is taken over by the engine computer (EEC) that selects a corresponding valve. The goal here is to set a clearance that is as small as possible, while at the same time any wear due to grazing, i.e. any running of the blade tip into the housing or the cover band, has to be avoided.

Systems that are modulatable in a fully modular manner are operated by means of a method in which the actual clearance is either measured or calculated by the engine computer. The actual clearance that is thus determined is compared to the target clearance, and the housing cooling is adjusted correspondingly by the control system.

Usually, the target clearance is set to be zero when the aircraft engine provides maximum thrust. The value for the target clearance can be higher than zero when the aircraft engine runs in the partial-load range. In this case, a sudden increase in thrust leads to a closure of the clearance, which cannot be compensated for fast enough by the reduced housing cooling, that is, it cannot keep the clearance constant. In this case, a target clearance that is too small would lead to a grazing contact.

SUMMARY

Therefore, what arises is the objective to create efficient systems for setting the radial clearance for the operation of aircraft engines, as well as corresponding aircraft engines.

The objective is achieved by a control system with the features as described herein.

For this purpose, the system has a model-based setting device, wherein the time-dependent clearance size can be approximated by the model-based setting device, with only those influencing variables being taken into account that have a time-dependent deformation behavior (e.g., elongation behavior) that is equal to or slower than the time-dependent deformation behavior of the housing (e.g., elongation behavior), wherein the clearance size in the cold state serves as the set point, with that clearance size being reduced by at least one previously saved value of a clearance proportion that is determined at maximal thrust of the aircraft engine, and wherein a control variable for a cooling system of the housing can be determined by the model-based controller.

By modeling only the slower proportions in the model-based controller, an efficient setting of the clearance size that is also suitable with view to the overall dynamics can be achieved.

In an advantageous embodiment, the model-based setting device for the influencing variables has a relationship for the thermal behavior of at least one rotor disc of a compressor stage and/or turbine stage and a relationship for the thermal behavior of the housing. In particular, the model-based setting device for the influencing variables comprises only relationships for the thermal behavior of at least one rotor disc of a compressor stage and/or turbine stage and the thermal behavior of the housing.

An efficient embodiment for the model-based setting device models the dynamic deformation behavior of structural components through step responses of the first order.

Further, it is advantageous if the set point of the clearance size can be determined exclusively based on values that are independent of the current thrust state of the aircraft engine. This independence can particularly be achieved by respectively determining the clearance proportions that are caused by the mechanical and thermal deformation behavior of a blade, the mechanical deformation behavior of a rotor disc, the thermal deformation behavior of an inlet device (e.g., of a liner, or a segment comprising a liner) and/or the mechanical deformation behavior of a housing at maximal thrust.

In one embodiment, the housing has at least one inlet device, in particular a liner, or a segment comprising a liner.

In another embodiment, calculated and/or measured values for the temperature, the pressure, the speed and/or the rotational speed are used in determining the control variable. In this way, further values are available for determining the control variable.

If the clearance size is taken into account in the input values of the model-based setting device, a control with a feedback is present. Otherwise, the system can also work without feedback.

The objective is also achieved by means of an aircraft engine having the features as described herein.

BRIEF DESCRIPTION OF THE DRAWINGS

The invention is explained in connection with the exemplary embodiments that are shown in the Figures.

DETAILED DESCRIPTION

Figure 1:
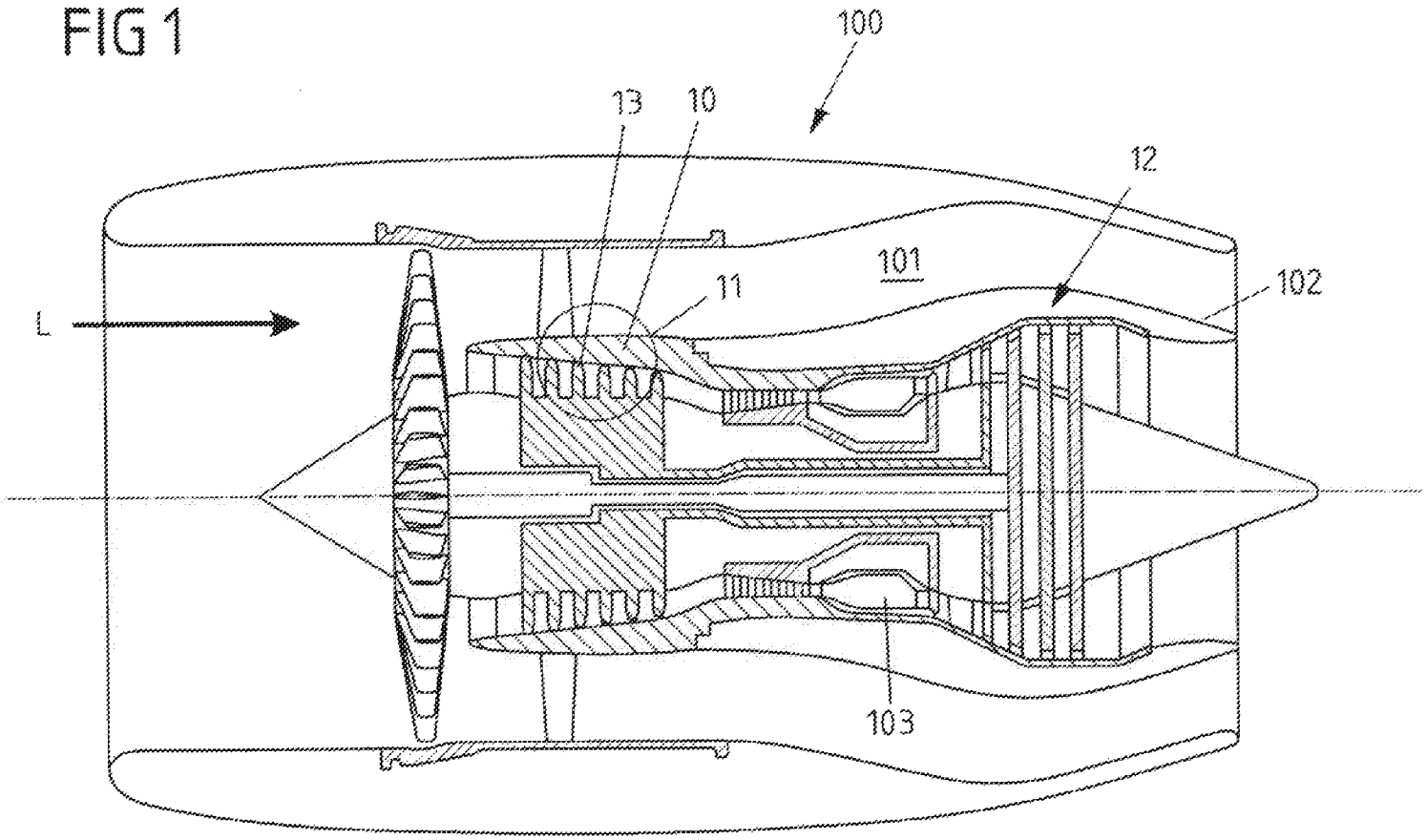
FIG. 1 shows a schematic rendering of an aircraft engine.

In FIG. 1, a per se known aircraft engine 100 is shown in a schematic manner, in which air L flows into the aircraft engine 100 from the front. The larger part of the inflowing air L is guided through the bypass channel 101 and is discharged in an accelerated state at the rear end of the aircraft engine 100.

A smaller part of the inflowing air L is conveyed into the core engine 102 and is compressed there inside a compressor with multiple compressor stages 11. The compressed air is supplied to the combustion chambers 103, wherein the compressed and heated-up air is then supplied to a turbine with turbine stages 12, wherein the air subsequently flows out in an accelerated state at the rear end of the aircraft engine 100.

Figure 2:
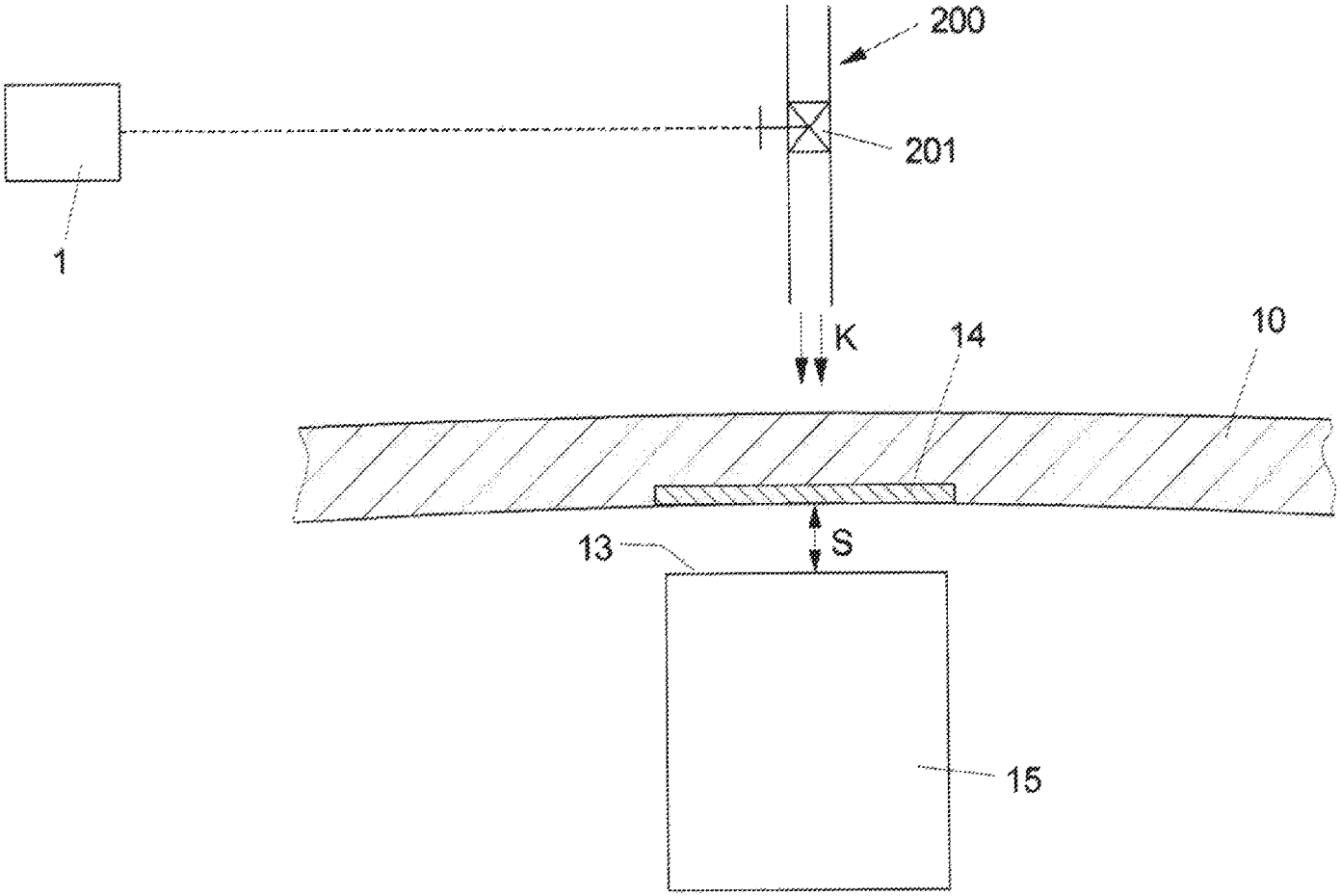
FIG. 2 shows a schematic rendering of a clearance and of the setting of the clearance size.

The rotating rotor blades 13 of the compressor stages 11 and of the turbine stages 12 are surrounded by a housing 10, with more details being shown in FIG. 2. It is to be understood that the rendering of FIG. 1 is merely exemplary in nature. The embodiments that are described in the following can also be used in connection with other engine designs.

FIG. 2 shows a section of the housing 10. Inside the housing 10, a rotor blade 15 is arranged on a rotor disc, with the rotor blade tip 13 being oriented radially towards the housing 10. A liner 14 is arranged inside the housing 10 opposite the rotor blade tip 13. In one embodiment of the present invention inside a turbine stage 12, the liner 14 is arranged in a segment that is subsequently connected to the housing.

The radial clearance with the clearance size S is located between the rotor blade tip 13 and the housing 10, and here in particular between the liner 14.

For the purpose of setting the clearance size S, a cooling system 200 is used in a per se known manner, by means of which cooling air K can be applied to the exterior of the housing 10. Through a system 1 for the active setting of the radial clearance size, a valve 201 of the cooling system 200 is set in such a manner that the clearance size S is adjusted to the respective requirements. What is important here is that the rotor blade tip 13 does not come into contact with the housing 10 or the liner 14. In the cold state, a radial relative clearance height (clearance/length of the rotor blade) of 3 to 4% can be aimed at. In the warm state, a relative clearance height of 1% or less is desirable.

Figure 3:
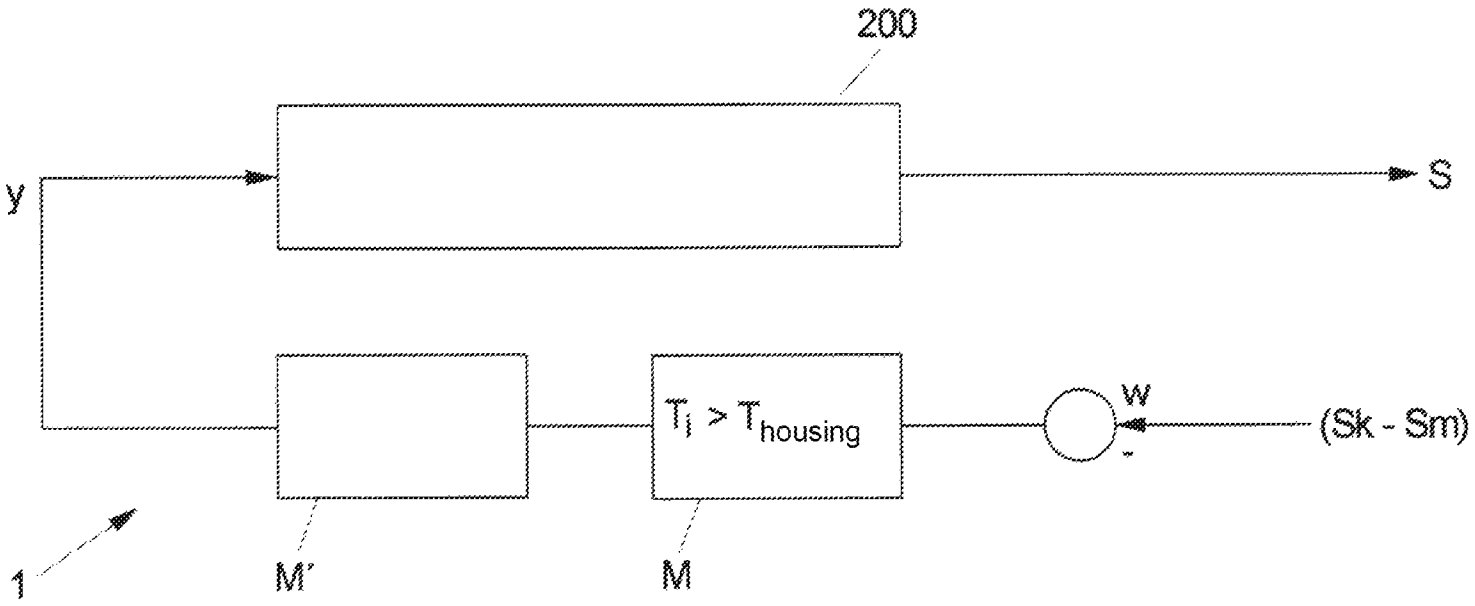
FIG. 3 shows a schematic rendering of an embodiment of the system for setting the clearance size.

FIG. 3 shows a scheme with an exemplary embodiment of the system 1 for the active setting of the radial clearance size S, by means of which the cooling system 200 can be set. For purposes of simplification, disturbance values have been omitted here.

System 1 comprises a model-based setting device M, which receives the set point w as an input value. Here, the set point w is the clearance size Sk in the cold state minus at least a previously saved value of a clearance proportion Sm that is determined at maximal thrust of the aircraft engine 100. This means that the set point w can be determined in a simple manner based on values that have been determined at one point and are then permanently stored.

In one embodiment, the clearance proportion Sm is determined at maximal thrust depending on the thermal behavior of a rotor blade 15, the deformation behavior of a rotor (e.g. the elongation behavior), the thermal behavior of the liner 14 and/or the pressure-dependent behavior of the housing 10. These influencing variables have faster dynamic reactions than other structural components, which will be explained in more detail in the following. By determining (and setting) the values at maximal thrust, these influences can be made independent of the respective thrust. In this way, a change of the thrust has no effect on the set points w.

Here, the structural components in the core engine 102 have different time constants T with respect to their deformation behavior (e.g., the expansion in the radial direction). Strains that occur due to the rotational speed act faster on the structural components than thermal influences, as the heat transfer occurs more slowly. In the event of acceleration, thin housings 10 receive the thermal elongations faster than do massive rotor discs. In some embodiments, a fast reaction can have time constants of significantly less than 60 seconds, in particular less than 30 seconds.

During a deceleration process, the structural components are subject to different thermal inertias, which leads to a faster reduction of the clearance size S. In this case, there is the danger that the rotor blade tips 13 graze the wall of the housing 10 or of the liner 14, for example during a re-acceleration where the rotor discs are still hot (hot re-slam). What is thus present is an overlapping of different mechanical (e.g., rotational-speed-related) or thermal dynamic effects; that is, there are faster and slower influencing variables.

In order to ensure an efficient setting, the system 1 comprises the model-based setting device M, with its model only taking into account those influencing variables that have a time-dependent deformation behavior (e.g., with the time constant $T_i$) that is slower than the time-dependent deformation behavior of the housing 10 (e.g., with the time constant $T_{housing}$). Here, the term "deformation behavior" in particular refers to the elongation behavior of the structural components under stress.

Thus, the time-dependent deformation behavior of the housing 10 serves as a reference for dynamic processes that are taken into account or, as the case may be, not taken into account in the model M.

In a particular embodiment of the system 1 comprising the model-based setting device M, the thermal behavior of the turbine rotor discs (i.e., the material from the shaft up to the root of the rotor blades 15) and the thermal behavior of the housing 10 are taken into account, for example. These dynamic influencing variables are comparatively slow. Faster influences, such as for example the thermal behavior of the rotor blades 15, the influence of the centrifugal force on the rotor blades 15, or the influence of the pressure on the housing 10 are not taken into account by the model-based setting device M.

Those thermal influencing variables for the turbine rotor discs and the housing 10 that are relevant to the model-based setting device M are saved in the model-based setting device M in a suitable form of mathematical relationship (e.g., differential equation, difference equation, transfer function). The goal here is to set the best value for the clearance size S with the control variable y for the cooling system 200.

One modeling option is to approximate the temporal deformation behavior, such as for example the dynamic elongation behavior x,(t) for a structural component I, by jump functions of the first order:

$$x_i(t) = x_{i,\infty} + (x_i(0) - x_{i,\infty})\left(e^{\frac{-t}{T_i}}\right)$$

At that, it is possible to create classes of step responses x(t) for structural components with fast as well as with slow elongation behavior, wherein the classification can be performed based on the time constant $T_i$. In addition, a constant $x_{i,\infty}$ for the stationary value of the elongation behavior is also used in the model for the step response.

The jump functions for all those structural components i (e.g., rotor blade 15, segment with liner, housing 10, rotor disc) that have time constants $T_i$ that are above a certain limit are used for the model-based setting device M.

In addition to these slow influencing variables, also (calculated and/or measured) values for the temperature, the pressure, the speed and/or the rotational speed can be used in determining the control variable y. In FIG. 3, this is shown by a second model component M'.

A model-based setting device M that is based on the slower influencing variables is more efficient than a model in which both fast and slow influencing variables are included. As a rule, the fast changes in the influencing variables cannot be compensated for fast enough by the cooling system 200, so that considering only the slower influencing variables results in a more steady setting of the clearance sizes, with the control variable y not being subjected to such strong variations.

FIG. 3 shows a control without a feedback, that is, the values for the clearance size S (i.e., of the control variable) are not taken into account in determining the control variable y. However, when determining the control variable y, it is also quite possible to take into account the clearance size S either directly or via values that are dependent therefrom, so that a control circuit with feedback is present. In this case, the clearance size S would be linked to the set point w.

Figure 4:
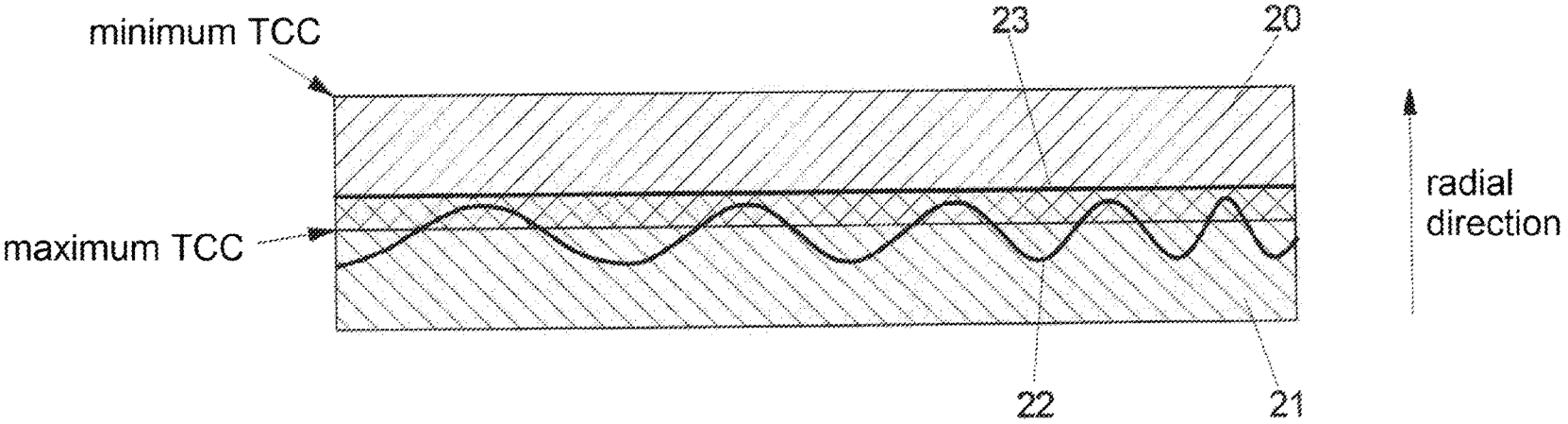
FIG. 4 shows a schematic rendering of possible or actual radial positions of the clearance changes at the rotor side and the housing side.

FIG. 4 schematically shows the time-dependent behavior of the different structural components as they are subjected to varying loads. In the upper part, the range 20 is shown inside of which the inner wall of the housing 10 can move. In the lower part, the range 21 is shown inside of which the rotor disc can move.

The thick solid line 22 illustrates the radial changes at the rotor blade tip 13, which have relatively high frequencies. The actual position of the inner housing wall 23 is indicated in FIG. 4 by a solid line.

In the event of minimum cooling (minimum TCC), the wall 23 of the housing 10 takes a position that is far outside with respect to the radial direction. In the case of maximum cooling (maximum TCC), the housing 10 contracts relatively far, so that the radius becomes smaller. In this event, at a high rotational speed the rotor would enter the housing and damage it.

In order to ensure that the rotor blade tip 13 does not graze the housing 10, the wall of the housing 10 has to be positioned in such a manner that the maximally possible position of the rotor blade 14 is radially smaller than the position of the housing 10, which is indicated by the solid line 23 in FIG. 4.

Through the model-based setting device M that is described in connection with FIG. 3, the thermal expansions of the rotor disc and the housing 10 are taken into account together; in one embodiment it is only exactly these that are considered.

Figure 5:
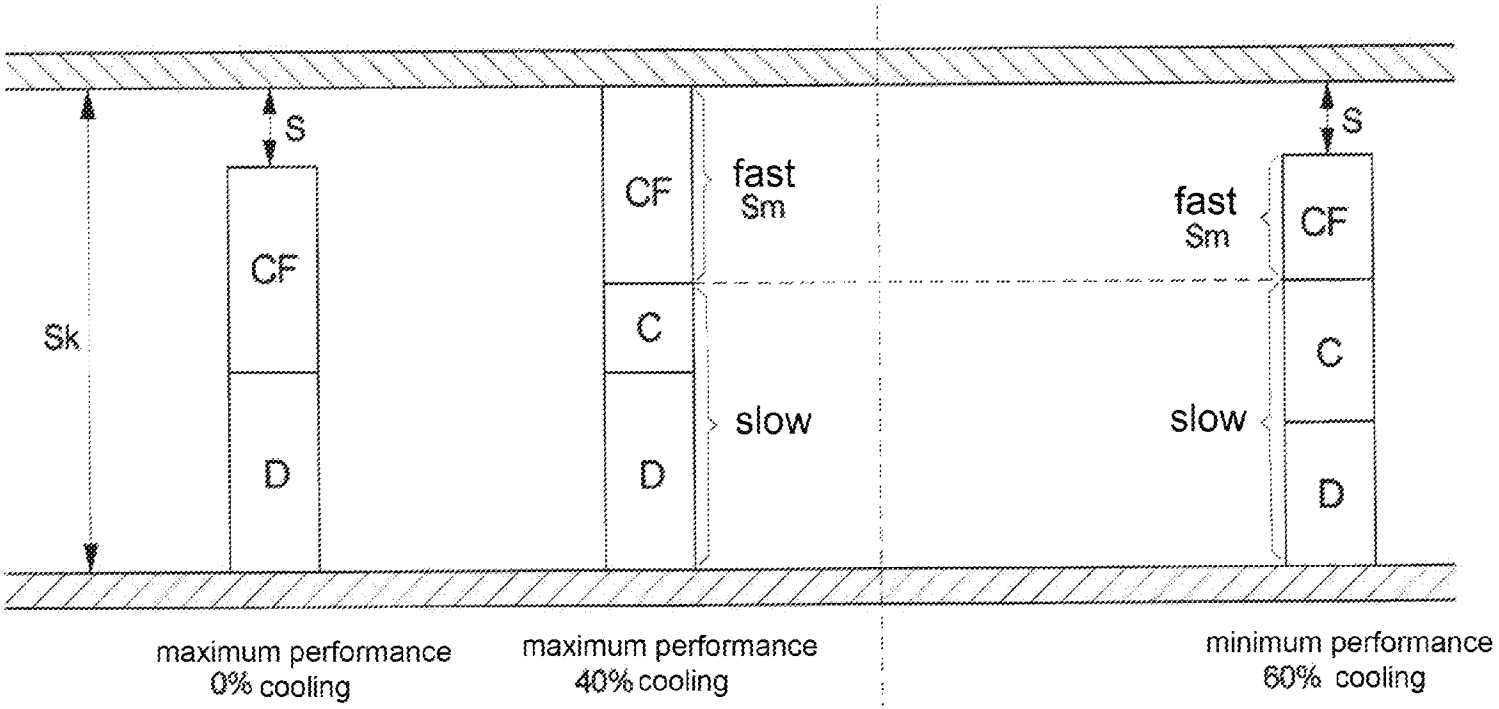
FIG. 5 shows a schematic rendering of different operational states.

FIG. 5 schematically shows the expansions of the different structural components for two different load cases. The respective goal is to fill out the clearance size in the cold state Sk.

In the left part of FIG. 5, the elongation proportions of the structural components, occurring at maximal performance but with respectively different cooling, are illustrated by two bars.

The left bar diagram shows the thermal elongation proportion of the rotor disc D and the proportion of the centrifugal force CF when the cooling is turned off (0%). This means that the housing 10 does not have any sizeable share in closing the clearance.

If the cooling is increased from 0% to 40%, which is shown in the middle bar diagram, the deformation C of the housing 10 has an effect on the closure of the clearance. This means that the closure is comprised of three proportions, namely the two relatively slow thermal proportions of the rotor disc D, of the housing C and of the fast proportion CF. The slow proportions are included in the model-based controller M.

The rest of the clearance closure at maximum performance and 40% cooling then [combines] the fast proportions Sm. This value can be determined at one point and can subsequently be reused, as is the case with the set point specification process in the embodiment that has been described above (see FIG. 3).

The right bar diagram shows the case of a medium power input but increased cooling (60%). The slower proportions of the clearance closure, i.e., the proportion D of the rotor disc and the proportion C of the housing elongation, in sum correspond to the two proportions at maximum performance but decreased cooling in the middle bar diagram.

The proportion CF of the centrifugal elongation is smaller, as the rotational speeds are lower at medium performance. If the set point calculation is carried out by means of the fast elongation proportions at maximal thrust (middle bar diagram), a small clearance remains in the right bar diagram, which is necessary as a safety distance if a switch is made from medium performance to maximum performance. This shows that the set point determination within the meaning of FIG. 3 represents a useful feature.

PART LIST

1 system for the active setting of a radial clearance size
10 housing
11 compressor stage
12 turbine stage
13 blade tips
14 inlet device, liner
15 rotor blade
20 range of the housing positions
21 range of the blade tip position
22 actual blade tip position
23 actual housing position
100 aircraft engine
101 bypass channel
102 core engine
103 combustion chamber
200 cooling system
201 valve
C thermal elongation proportion of the housing due to cooling
CF elongation proportion due to centrifugal forces
D thermal elongation proportion of the rotor disc
L inflowing air
K inflowing cooling air
M model-based setting device
S gap size, radial (setting value, control variable)
Sk gap size in the cold state
Sm clearance proportion during maximal thrust
T time constant
w set point
y control variable

The invention claimed is:

1. A system for an active setting of a radial clearance dimension between a blade tip of at least one chosen from a compressor stage and a turbine stage of an aircraft engine, and a housing surrounding the at least one chosen from the compressor stage and the turbine stage, the system comprising:

a model-based setting device configured and programmed for:

approximating the radial clearance dimension using an influencing variable with a time-dependent deformation behavior equal to or slower than a time-dependent deformation behavior of the housing, including:

a previously saved radial clearance proportion determined at a maximal thrust of the aircraft engine, and a radial clearance dimension set point based on the radial clearance dimension in a cold state, calculating a reduced radial clearance dimension from the radial clearance dimension set point using the previously saved radial clearance proportion, calculating a control variable for controlling a cooling system of the at least one chosen from the compressor stage and the turbine stage based on the reduced radial clearance dimension, and controlling the cooling system based on the control variable.

2. The system according to claim 1, wherein the aircraft engine further comprises a rotor disc located in the at least one chosen from the compressor stage and the turbine stage;

wherein the influencing variable is a thermal behavior of the rotor disc; and wherein the model-based setting device further includes a relationship for the thermal behavior of the rotor disc and a relationship for a thermal behavior of the housing.

3. The system according to claim 1, wherein the aircraft engine further comprises a rotor disc located in the at least one chosen from the compressor stage and the turbine stage;

wherein the influencing variable consists of a thermal behavior of the rotor disc; and wherein the model-based setting device further includes a relationship for the thermal behavior of the rotor disc and a thermal behavior of the housing.

4. The system according to claim 1, wherein the aircraft engine includes a structural component located in the aircraft engine;

wherein the influencing variable is a time-dependent deformation behavior of the structural component; and wherein the model-based setting device models the time-dependent deformation behavior of the structural component by a linear step response.

5. The system according to claim 1, wherein the model-based setting device determines the radial clearance dimension set point exclusively from a value independent of a current thrust state of the aircraft engine.

6. The system according to claim 1, wherein the aircraft engine further comprises a rotor disc and a housing; and wherein the previously saved radial clearance proportion is determined by at least one chosen from a thermal behavior of a blade, a deformation behavior of the rotor disc located in the at least one chosen from the compressor stage and the turbine stage, a thermal behavior of an inlet device located inside the housing, and a pressure-dependent behavior of the housing.

7. The system according to claim 1, further comprising a housing, wherein the housing includes at least one inlet device.

8. The system according to claim 7, wherein the inlet device is a liner.

9. The system according to claim 7, wherein the inlet device is a segment comprising a liner.

10. The system according to claim 1, wherein at least one chosen from a calculated value and a measured value for at least one chosen from a temperature, a pressure, a speed, and a rotational speed are used in determining the control variable.

11. The system according to claim 1, wherein the radial clearance dimension is taken into account in an input value of the model-based setting device.

12. An aircraft engine with at least one system according to claim 1.

* * * * *